US010314403B2

(12) United States Patent
Schmidt

(10) Patent No.: US 10,314,403 B2
(45) Date of Patent: Jun. 11, 2019

(54) CHAIR / GAME COMBINATION

(71) Applicant: Karen S. Schmidt, Oshkosh, WI (US)

(72) Inventor: Karen S. Schmidt, Oshkosh, WI (US)

( * ) Notice: Subject to any disclaimer, the term of this patent is extended or adjusted under 35 U.S.C. 154(b) by 0 days.

(21) Appl. No.: 15/939,072

(22) Filed: Mar. 28, 2018

(65) Prior Publication Data

US 2018/0279788 A1 Oct. 4, 2018

Related U.S. Application Data

(60) Provisional application No. 62/478,438, filed on Mar. 29, 2017.

(51) Int. Cl.
*A47C 1/14* (2006.01)
*A47C 7/62* (2006.01)
*A63B 67/06* (2006.01)

(52) U.S. Cl.
CPC ..... *A47C 7/62* (2013.01); *A47C 1/14* (2013.01); *A63B 67/06* (2013.01); *A63B 2067/063* (2013.01); *A63F 2250/326* (2013.01)

(58) Field of Classification Search
CPC .. A47C 7/62; A47C 1/14; A63B 67/06; A63B 2067/063; A63F 2250/326
USPC ..... 297/900, 188.08, 217.1, 452.63, 452.64, 297/223
See application file for complete search history.

(56) References Cited

U.S. PATENT DOCUMENTS 244,216 A 7/1881 Fenby
3,094,358 A * 6/1963 Hartman ..... A47C 4/30 297/39
4,062,590 A * 12/1977 Polsky ..... A47C 5/06 297/452.2
5,438,715 A 4/1995 Jackman
8,708,406 B1 * 4/2014 Powell ..... A47C 21/00 297/188.06
9,550,101 B2 * 1/2017 Janeri ..... A63B 67/06
9,950,230 B2 * 4/2018 Silva ..... A63B 71/0036
(Continued)

FOREIGN PATENT DOCUMENTS

WO WO2016/112223 7/2016

OTHER PUBLICATIONS

Wolner, Elizabeth "Liz Takes on PDES3701" Oct. 12, 2014, available online at http://woln0037pdes.blogspot.com/.
(Continued)

*Primary Examiner* — Milton Nelson, Jr.
(74) *Attorney, Agent, or Firm* — Cherskov Flaynik & Gurda, LLC

(57) ABSTRACT

The invention provides a combination chair and bean bag game comprising a horizontally disposed frame having a first end, second end, and medially facing surface; a vertically disposed frame having a first end, second end, and medially facing surface, wherein the first end of the vertically disposed frame extends from the first end of the horizontally disposed frame; a webbing, or webbings overlaying the medially facing surfaces of the horizontally and vertically disposed frames; legs to keep the frame above the ground and support the weight of a person seated on the fabric cover overlaying the frame; an aperture extending through a portion of the webbing overlaying the horizontally disposed frame and positioned between the first and second ends of the horizontally disposed frame.

15 Claims, 5 Drawing Sheets

(56) References Cited

U.S. PATENT DOCUMENTS

| | | | | |
|---|---|---|---|---|
| 2005/0262641 | A1* | 12/2005 | Maslyar | A47C 1/14 5/725 |
| 2006/0255648 | A1* | 11/2006 | Fleites | A47C 1/143 297/31 |
| 2015/0054318 | A1 | 2/2015 | Howard | |
| 2016/0166068 | A1* | 6/2016 | Holzhauzer | A63B 67/06 297/16.1 |

OTHER PUBLICATIONS

Toss-Sit Product Information, Jan. 1, 2015, available online at http://www.toss-sit.com/home.html.

* cited by examiner

CHAIR / GAME COMBINATION

PRIORITY

This utility patent application claims the benefits of U.S. Provisional Patent Application Ser. No. 62/478,438 filed on Mar. 29, 2017, the entirety of which is incorporated herein by reference.

BACKGROUND OF THE INVENTION

1. Field of the Invention

This invention relates to convertible chairs and more specifically, this invention relates to a combination chair-bean bag game requiring no mechanical changes between the two uses.

2. Background of the Invention

Portable chairs of the lawn/beach/camping variety are common fixtures on recreational trips. On these trips, there is often a need for a form of entertainment whether for adults or children. With this need for entertainment normally comes the need to lug any additional items wanted for entertainment, one common form of such entertainment is corn-hole or similar beanbag tossing type games.

Such games can be quite cumbersome and a hassle to carry, unpack, repack etc. Typical bean bag game accoutrement include large, wedge-shaped rigid boxes with a hole or plurality of holes adapted to receive bean bags tossed by players from a distance. More than one owner of a corn-hole set has been seen trying to give away their set instead of packing it up and carrying it away from the site of a gathering.

A need exists in the art for a combination chair/game having convenient features. The combination should require minimal modification to go between the chair and game configurations. The combination also should not require the addition of any backstop or game surface. It should feature reversibly covered holes in standard seat webbing whereby the holes can be uncovered to reveal a corn-hole type game. The holes may be lined with a netting to catch beanbags or other tossed objects.

SUMMARY OF INVENTION

An object of the invention is to provide a chair-game combination that overcomes many of the drawbacks of the prior art.

Another object of the invention is to provide a combination portable chair-bean bag game. A feature of the invention is that the back and seat of the chair comprise regions forming apertures, the apertures adapted to receive bean bags thrown from a remote distance. An advantage of the invention is that no structural modification of the chair is required when using the device as a chair, or using it as a game. Therefore, no time is needed to alternate between uses.

Briefly, the invention provides a combination chair and bean bag game for use by a remotely positioned player, the invention comprising a chair frame comprising a horizontally disposed frame having a first end, second end, and medially facing surface; a vertically disposed frame having a first end, second end, and medially facing surface, wherein the first end of the vertically disposed frame extends from the first end of the horizontally disposed frame; a fabric cover overlaying the medially facing surfaces of the horizontally and vertically disposed frames; means for maintaining the frame above the ground and supporting the weight of a person seated on the fabric cover overlaying the frame; and at least one aperture extending through a portion of the fabric cover overlaying the horizontally disposed frame, wherein the aperture is positioned intermediate the first and second ends of the horizontally disposed frame.

The invention would be used by a player or plurality of players remotely positioned relative to the chair, such as positioned a distance typical of that taken up by bean bag players.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
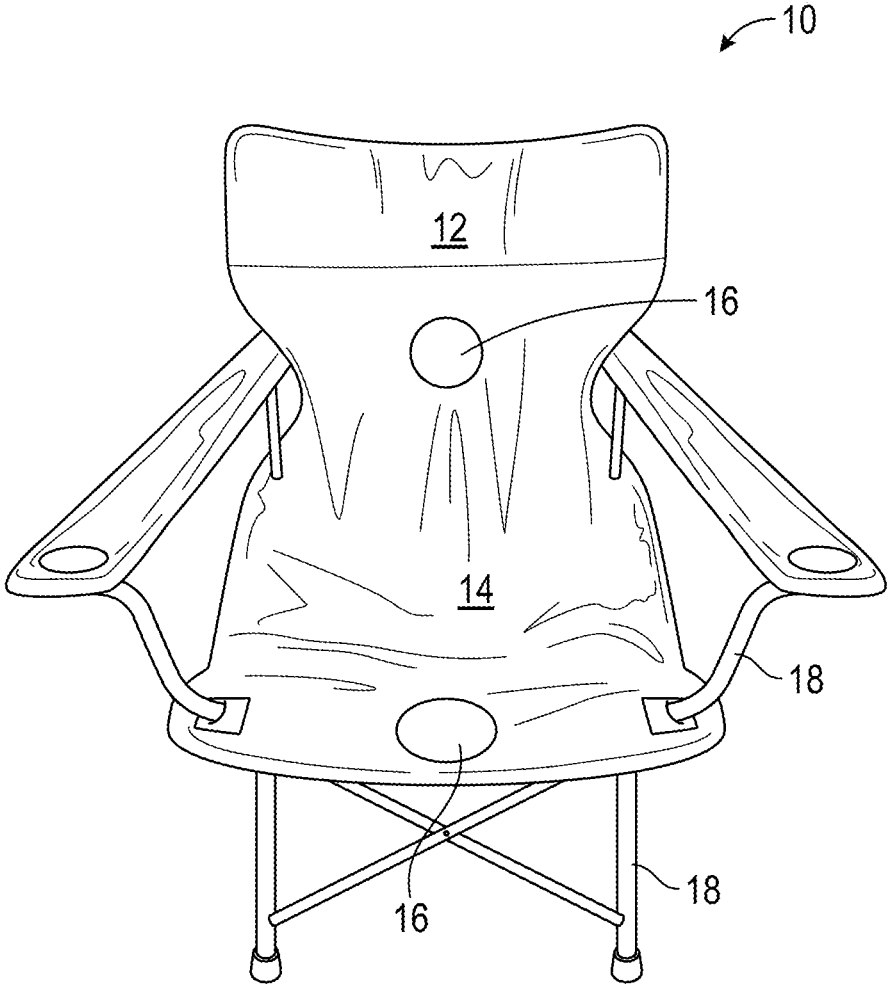
FIG. 1 is a front view of the invention, in accordance with features of the present invention.

FIG. 1 depicts the invention, designated as numeral 10 in its fully usable state. As noted supra, a salient feature of the invention is that it can be used as a chair or as a bean bag game backstop with no reconfiguration of the chair prior to gaming. The configuration of any outdoor fabric cover chair can serves as the foundation for the invented chair-game combination. Ideally, the chair would be collapsible. A myriad of collapsible chairs are candidates for such modification, including the folding chair depicted in U.S. Pat. No. 244,216, issued in 1881, the entirety of that patent incorporated herein by reference. Chairs with or without cup holders are also suitable candidates, particularly as those cup holders can also serve as additional targets for bean bags and other projectiles.

Common elements of various embodiments of the invention include a first vertically disposed webbing 12, a second horizontally disposed webbing 14 and a region of either the vertically disposed webbing 12 or the horizontally disposed webbing 14 forming an aperture 16. FIG. 1 depicts the invention 10 with an aperture formed in both its horizontally and vertically disposed webbings.

The invention 10 may comprise just one aperture, that one aperture formed in the vertically disposed webbing. The invention 10 may comprise just one aperture 16 formed in the horizontally disposed webbing. Still other variations of the invention may feature more than one aperture in each the horizontally disposed and vertically disposed webbings. FIG. 4D depicts the invention whereby two apertures are formed in upwardly projecting webbing.

The apertures are configured so as to receive bean bags, balls, or other thrown objects as part of a lawn game. As such, the cross section of the apertures may vary from about 3 inches to 9 inches, and preferably from 4 inches to 8 inches, and most preferably from 5 to 6 inches.

Furthermore, the cross section of the apertures may be reversibly adjustable, for example via a drawstring interlaced about the periphery of the apertures, so as to vary the skill level required to play the game. This drawstring feature also provides a means for storing loose pieces comprising the game (e.g., bean bags), sunglasses, cigarettes, sun tan lotion, or other items. Other means for varying the cross section of the apertures include flaps secured in hook and pile configurations, zippers or buttons to partially close peripheral regions of the apertures.

Preferably, the vertically disposed 12 and horizontally disposed 14 webbing are shaped as squares or rectangles and are made of a flexible material such as canvas, plastic, hemp, or some breathable material. Given the flexible nature of the webbing, a frame 18 underlays the material, the frame being foldable or collapsible so as to facilitate easy deployment and stowage. Generally, the frame comprises a first and a second weight support construct adapted to receive and conform the flexible material to the desired shapes of horizontally and vertically disposed webbings. The frame further comprises a plurality of legs (for example at least three) to elevate and/or otherwise maintain the horizontally disposed webbing 14 above the ground. The legs may be pivotally attached to the weight support construct so as to facilitate collapsibility and deployment of the entire chair.

Material comprising the frame are generally rigid substrates selected from the group consisting of resin, plastic, wood, metal and combinations thereof.

The vertically disposed 12 and horizontally disposed 14 surfaces may be two regions of a continuous webbing such that the two surfaces are continuous with each other. Examples of this continuity are depicted in FIGS. 5A-D. Furthermore, the surfaces may comprise a material which may be water proof or alternatively breathable, translucent, transparent, or opaque. The surface may also be printable so as to impose game indicia thereon. Exemplary materials include, but are not limited to canvas, cloth, nylon, flexible polymer, paper, Styrofoam, and combinations thereof.

Alternatively, the vertically and horizontally disposed webbings may not be continuous such that the vertically disposed webbing is separate from the horizontally disposed webbing. This will allow for easy change out, replacement or repair if one webbing becomes torn or otherwise not functional. Also, this allows for different types of surfaces (topography wise) being used for vertical versus horizontal webbings. For example, the horizontal webbing may be comprised of a slicker surface than the vertical webbing to provide a further challenge to players, wherein the bean bag may slide over the aperture given less friction imposed by that slicker horizontal surface. As such, one of the horizontally or vertically disposed surfaces may impose relatively more frictional engagement with incoming bean bags. Or, one of said surfaces may be relatively more uneven in topography than the other surface, perhaps mimicking a geological formation, or the body form of an animal (mammal, reptile, or bird, living or extinct), with apertures arranged to correspond with hills, valleys, lakes, and canyons of the formation, or apertures of the animal (e.g., the eyes, nose, mouth, navel, etc).

The webbing may be completely replaced on one or both surfaces with elongated strips of webbing, typically seen on lawn chairs. For example, the vertically disposed surface of the chair may comprise a plurality of elongated strips 33 and vertically disposed spaces 35 between the elongated strips, such that the vertically disposed surface of the chair is discontinuous (See FIG. 4.). Provisions would be made between these strips for the afore-described apertures.

Each of the vertically disposed 12 and horizontally disposed 14 substrates comprise a first medially facing surface 20, 22 respectively as depicted in FIG. 1. The laterally facing surface of the vertically disposed substrate 12 is adapted to contact the back of a person seated within the chair.

Figure 2:
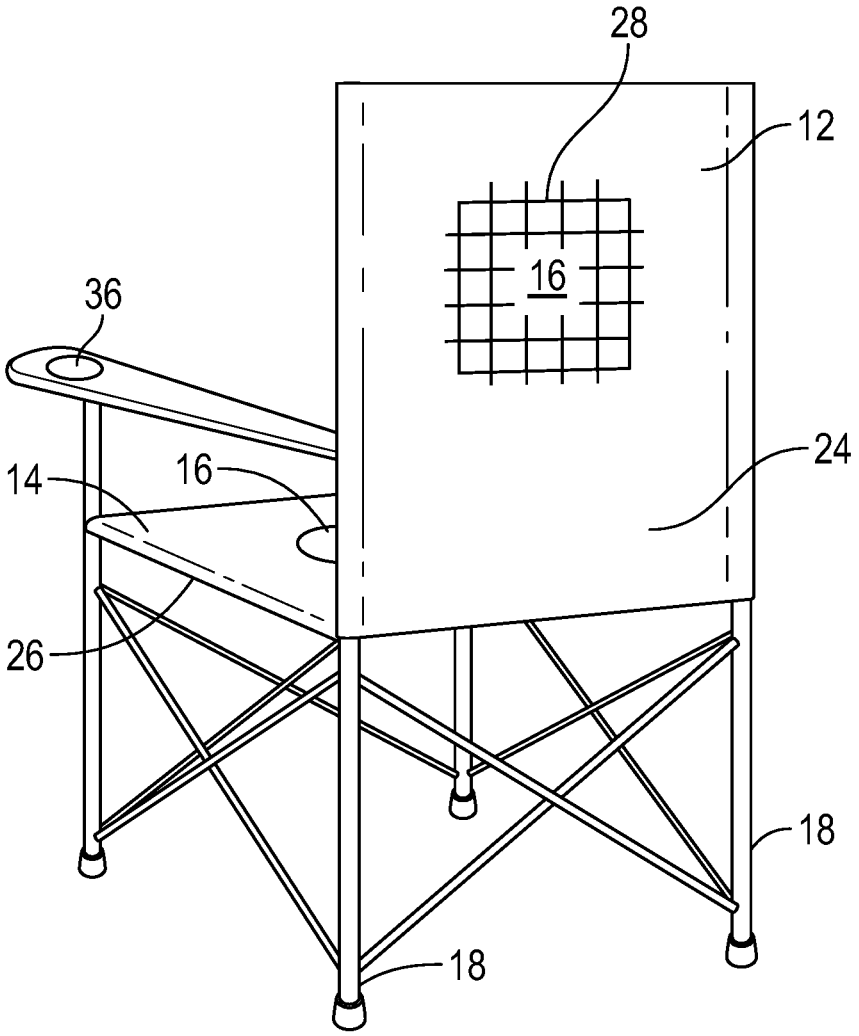
FIG. 2 is a rear perspective view of the invention, in accordance with features of the present invention.

Likewise, the laterally facing surface of the horizontally disposed substrate 14 is adapted to contact and support the buttocks and legs of the sitting person. Conversely each of the vertically disposed substrate 12 and horizontally disposed 14 substrates comprise and a second laterally facing surface 24, 26, as depicted in FIG. 2.

Optionally, a netting 28 may be draped over the apertures on the laterally facing surfaces 24, 26 of either the first vertically disposed substrate 12 or the second horizontally disposed substrate 14. This netting provides a means for collecting whatever projectiles make their way through the respective apertures during game play.

Figure 3:
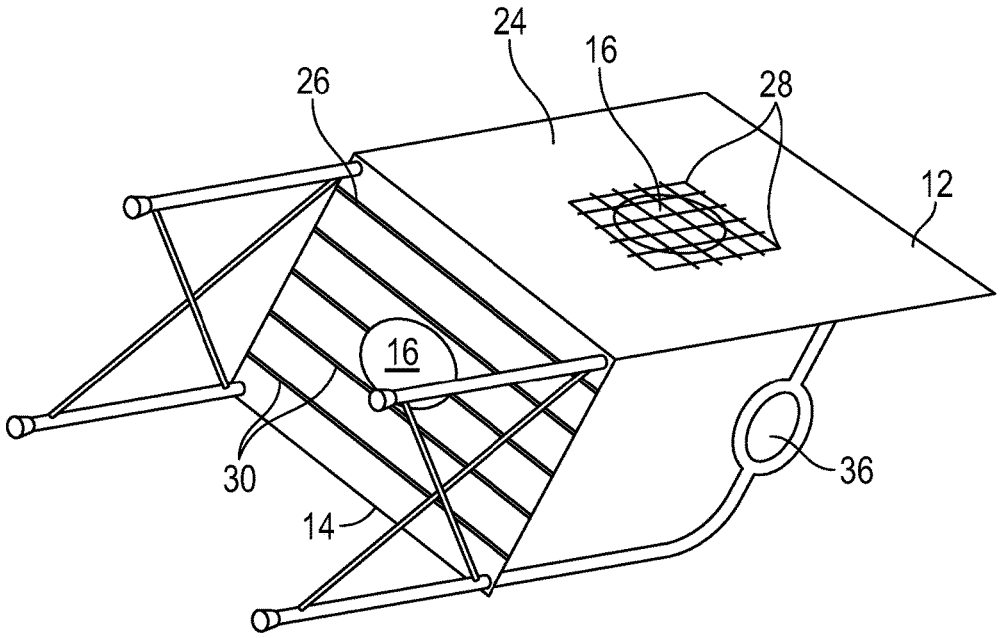
FIG. 3 is an underside perspective view of the invention wherein the chair-game device is positioned with its right front leg contacting a support surface, in accordance with features of the present invention.

A variation of the invention may include a plurality of semi-rigid or rigid elongated substrates 30 removably received by the underside 26 of the horizontally disposed surface, as depicted in FIG. 3. The substrates would confer either a concave or convex topography to the laterally facing surface of the respective vertically or horizontally disposed substrate, thereby varying the skill level necessary to successfully guide bean bags or other projectiles through the effected aperture 16 from a remote pitching point.

The rigid elongated substrates 30 may also provide a means for forming plateaus or peaks upon which gamers may aspire to alight their bean bags.

Regions of the underside 26 of the horizontally disposed surface 14 may comprise sleeves defining a cross section slightly greater than the cross section of the elongated substrates. As such, the sleeves are adapted to reversibly receive the elongated substrates.

The invention may include flaps positioned in close spatial relation to the apertures 16. The flaps 32 (FIG. 4) are adapted to completely cover the apertures in instances where the person desires a completely closed seat or back rest. The flaps may be integrally molded to their respective vertically or horizontally-disposed substrate or removably attached via standard means such as hook and pile, zipper, button, laces or other such fasteners.

Figure 4:
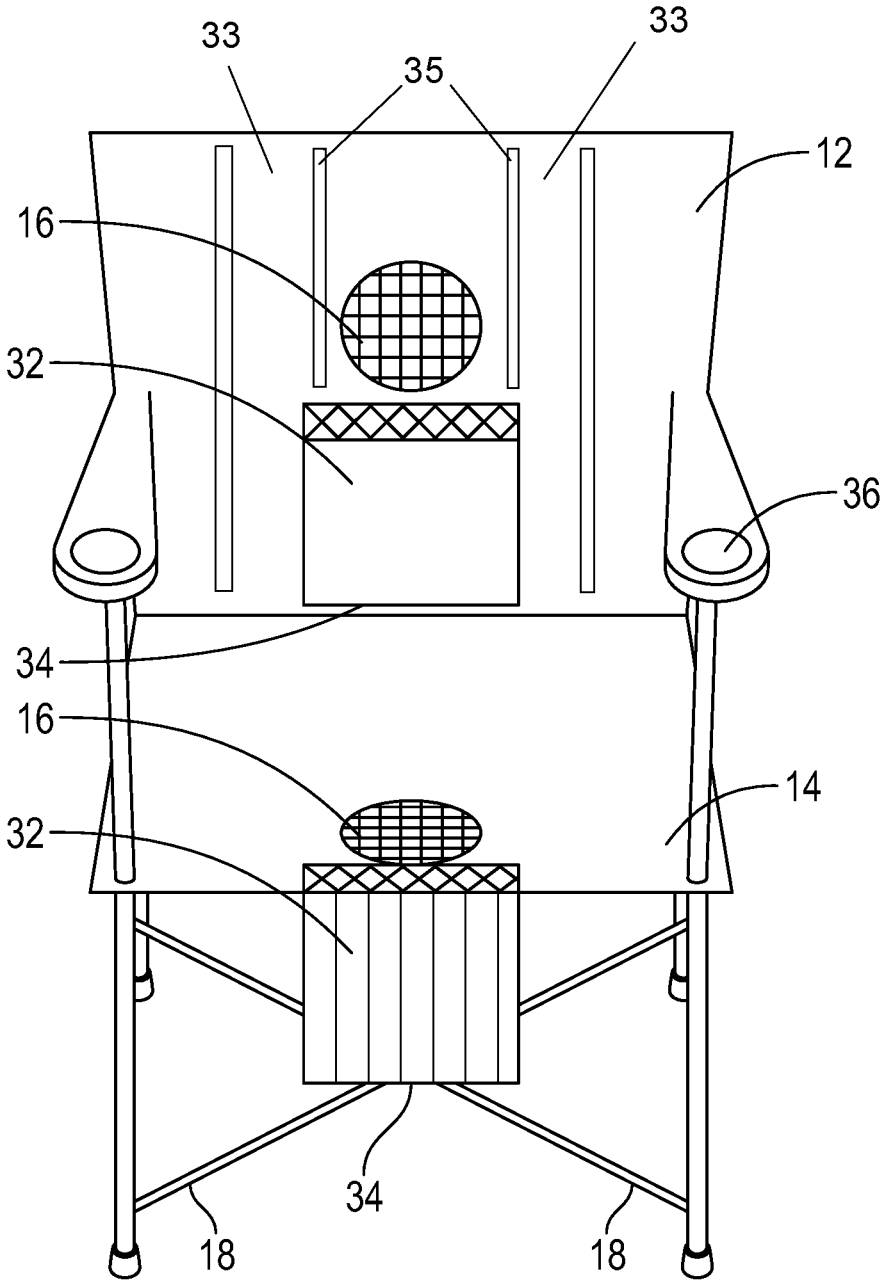
FIG. 4 is a front perspective view of the invention, in accordance with features of the present invention.

In the device shown in FIG. 4, a seat flap 32 is shown hanging down toward the ground in an un-deployed, depending position. This flap, having a first sitter-contacting surface and second surface, is so arranged during game play. After game play, would be sitter would swing or otherwise rotate the distal free end 34 of the flap up and in front of the front edge of the chair, and cover the hole, such that the first surface of the flap is visible to the sitter. An edge of the flap defining the distal end 34 of the seat flap would contain a hook and pile fastening mechanism (e.g. Velcro) so as to facilitate removably fastening of the flap over the hole, and to a proximal portion of the horizontally disposed substrate 14 defining mating fastener means, such as a complimentary hook and pile surface.

Similarly, FIG. 4 depicts an un-deployed back flap hanging in front of the seat back such as what would occur during game play. Game indicia may be printed on the second (medially facing) surface of the flap. After game play, the user would swing up the flap 32 and attach its distal edge 34 to a region above its respective aperture after game play to close the hole to confer added comfort. At this juncture, the first (sitter-contact) surface is visible. The region of the vertically disposed substrate 12 defining a superior periphery of the aperture (e.g., toward the top ledge of the seat) would support or otherwise define a complimentary hook and pile (e.g. Velcro®) fastening mechanism.

In both flap usage scenarios, when the flaps 32 are closed, the user sitting in the chair would be contacting the first surface of the flaps. In an embodiment of the invention, the flaps do not close the apertures from underneath or behind the chair. (This will allow for indicia, printed on the now visible first surface of the flap, to be viewed by the sitter from above, i.e., when the seat is upright.) Rather, the flaps, when fully deployed cover the holes at the top of the seat hole and front of the holes. Conversely, the second surface of the flaps 32, when the flaps are un-deployed, are visible from the front of the chair.

It must be appreciated that a myriad of chair frames are suitable for use with the invention. For example, several beach chairs are adapted to be used in 4 or five positions, ranging from up right, to completely flat. The inventor envisions that a substantially flat configuration will provide two horizontally disposed substrates for gamers with a first region forming apertures closer to the bean bag tosser and a second region forming apertures relatively further from the tosser. Exemplary configurations include those lawn lounge chairs depicted in FIG. 5.

Figure 5A:
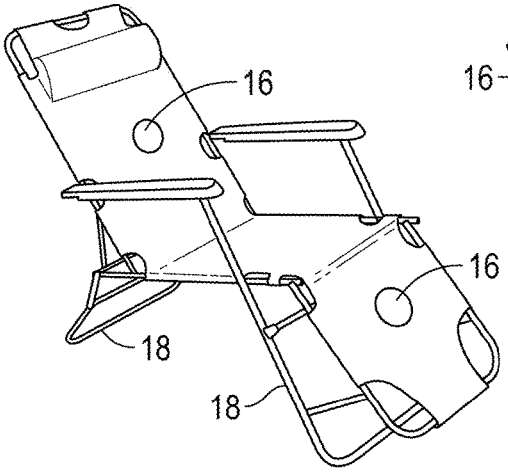
FIG. 5A is a perspective side view of a lawn chair with a dropped front portion, in accordance with features of the present invention.

FIG. 5A is a perspective side view of a lawn chair with a dropped front portion such that the dropped front portion defines a first surface which may be parallel with a second relatively higher planar portion defining the back rest of the chair. Alternatively, the first planar and second planar portion may not be parallel with each other, such that the dropped front portion and the back rest are independently adjustable relative to each other. This enhances the challenge to any toss competitors. FIG. 5A depicts the chair with three separate planar surfaces, a third surface disposed between the first and second portion.

Figure 5B:
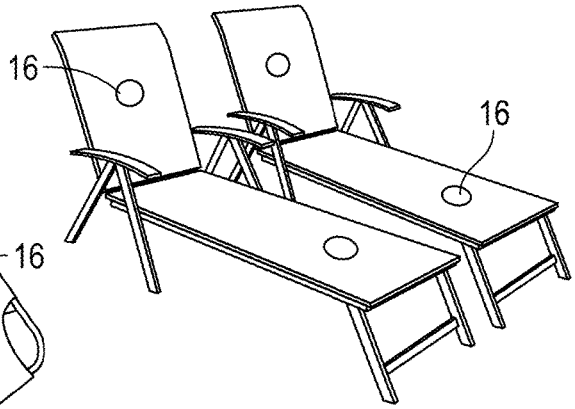
FIG. 5B is a perspective side view of two lawn chairs with a nonadjustable horizontal support surface, in accordance with features of the present invention.

FIG. 5B is a perspective side view of a lawn chair not defining a dropped front portion. As with the chair depicted in FIG. 5A, this lawn chair features two apertures 16. Unlike the chair depicted in FIG. 5A, this chair defines only two surfaces, a back support surface and a lower body support surface. Only its back surface is adjustable relative to the lower body support surface. The lower body support surface is generally parallel with the ground.

Figure 5C:
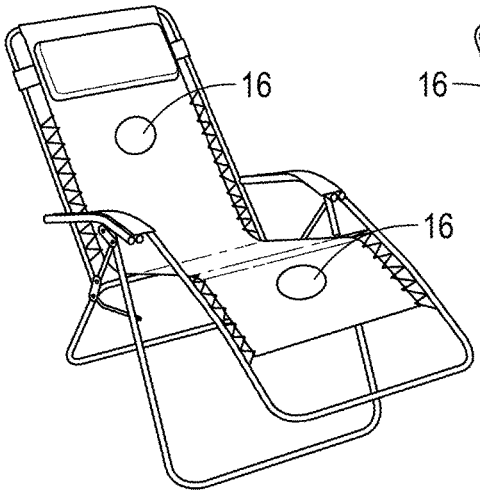
FIG. 5C is a three-panel lawn chair comprising longitudinally aligned, elongatable panels defining bean bag apertures, in accordance with features of the present invention.

FIG. 5C is a perspective side view of a lawn chair similar to the chair depicted in FIG. 5A. Three surfaces are present, a first dropped portion, a second relatively higher portion defining the back rest of the chair, and a third surface disposed between the first and second portion. The third surface may further define a third aperture (not shown). The third surface may be adjustable relative to the ground so as not to be parallel thereto. FIG. 5C features a single web to define the three surfaces, that web adapted to be elongated along its longitudinal axis. This elongation provides a means for contorting the absolute shape of the apertures, instead of just the appearance of contortion.

Figure 5D:
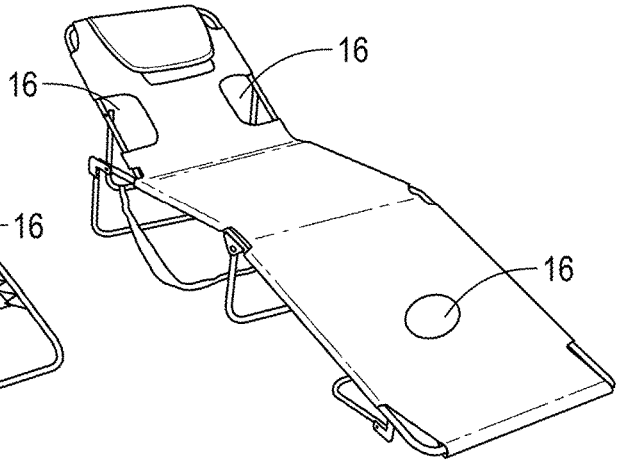
FIG. 5D is a three-panel lawn chair with laterally positioned panels defining apertures and adjustable relative to each other, in accordance with features of the present invention.

FIG. 5D shows three apertures, two of which are formed within a slightly upwardly angled webbing so as to be positioned opposite the other's medial edge. The third aperture is formed within slightly downwardly sloping webbing in a region proximal to a where a sitter's feet would be positioned. However, this foot support portion webbing may be adjustable to be parallel with the buttocks support webbing. The buttocks support webbing is positioned between the upwardly angled webbing defining the two apertures and the foot support webbing.

The movable features of the webbing portions of the chairs depicted in FIGS. 5A-D provide a means for changing the shapes of the apertures to enhance play. The combination chair and bean bag game may feature its horizontally disposed frame adapted to be adjusted independent from the vertically disposed frame as a means to contort the shape of the apertures from the view of the player. For example, a aperture in a webbing that is disposed relatively parallel with the ground (FIG. 5B) will present a more ellipsoid shape (and therefore more challenging target) than if the webbing is in a drop down configuration (FIG. 5A). This relative contortion is different than that achieved by the actual absolute contortion of the stretchable webbing in FIG. 5C.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. The apertures 16 may be polygonal (e.g., rectangular, triangular, diamond shaped or shaped as animals or familiar objects) instead of just circular. Cup holders 36, integrally molded within the webbing of the chair, or attached to the arms of the chair may also serve as game elements.

While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A combination chair and bean bag game for use by a remotely positioned player, the combination comprising:

a) a chair frame comprising a horizontally disposed frame having a first end, second end, and medially facing surface;

b) a vertically disposed frame having a first end, second end, and medially facing surface, wherein the first end of the vertically disposed frame extends from the first end of the horizontally disposed frame;

c) a webbing overlaying the medially facing surface of the horizontally disposed frame and a webbing overlaying the vertically disposed frame wherein the webbing overlaying the vertically disposed frame defines a aft facing surface;

d) means for maintaining the frame above a ground and supporting a weight of a person seated on the webbing overlaying the frame;

e) a first aperture extending through a portion of the webbing overlaying the horizontally disposed frame; and f) a netting draped over an aperture on the aft facing surface.

2. The combination chair and bean bag game of claim 1 wherein the netting and apertures are not configured to bear the weight of an abdomen or a trunk of a user.

3. The combination chair and bean bag game as recited in claim 1 wherein the webbing overlaying the horizontally disposed frame has a different topology than the webbing overlaying the vertically disposed frame.

4. The combination chair and bean bag of claim 1 further comprising a reversibly attachable cover configured to overlay the first aperture.

5. The combination chair and bean bag game as recited in claim 1 wherein the webbing overlaying the horizontally disposed frame is comprised of a slicker surface than the surface of the webbing overlaying the vertically disposed frame such that the webbing overlaying the horizontally disposed frame imposes less friction to a bean bag.

6. The combination chair and bean bag game as recited in claim 5 wherein the webbing overlying the vertically disposed frame comprises a plurality of elongated strips and vertically disposed spaces between the elongated strips.

7. The combination chair and bean bag game as recited in claim 1 wherein a region of the webbing positioned horizontally has a first surface facing upwardly and a second surface facing downwardly, wherein the second surface comprises elongated substrates.

8. The combination chair and bean bag game as recited in claim 7 wherein the elongated substrates are arranged parallel to each other.

9. The combination chair and bean bag game as recited in claim 7 wherein the elongated substrates are not parallel to each other.

10. The combination chair and bean bag game of claim 1 wherein the aperture on the aft facing surface extends through a portion of the webbing overlaying the vertically disposed frame.

11. The combination chair and bean bag of claim 10 wherein the apertures are shaped to reversibly receive a bean bag.

12. The combination chair and bean bag game as recited in claim 10 wherein the vertically disposed frame is adapted to be adjusted independent from the horizontally disposed frame as a means to contort a shape of the apertures from view of the player.

13. The combination chair and bean bag game as recited in claim 10 wherein the horizontally disposed frame is adapted to be adjusted independent from the vertically disposed frame as a means to contort a shape of the apertures from view of the player.

14. The combination chair and bean bag game as recited in claim 10 further comprising flaps having a first position covering each of said apertures and a second position uncovering each of said apertures.

15. The combination chair and bean bag game as recited in claim 14 wherein the flaps are adapted to be manipulated independent of each other.

* * * * *